US011167913B2

(12) United States Patent
Draghetti et al.

(10) Patent No.: US 11,167,913 B2
(45) Date of Patent: Nov. 9, 2021

(54) SPACER SUPPORT FOR PACKETS OF SMOKING ARTICLES, SPACER KIT AND PACKAGE CONTAINING SAID SPACER KIT

(71) Applicant: I.M.A. INDUSTRIA MACCHINE AUTOMATICHE S.P.A., Ozzano dell'Emilia (IT)

(72) Inventors: Fiorenzo Draghetti, Ozzano dell'Emilia (IT); Luca Tarozzi, Ozzano dell'Emilia (IT)

(73) Assignee: I.M.A. INDUSTRIA MACCHINE AUTOMATICHE S.P.A., Ozzano dell'Emilia (IT)

( * ) Notice: Subject to any disclaimer, the term of this patent is extended or adjusted under 35 U.S.C. 154(b) by 10 days.

(21) Appl. No.: 16/702,529

(22) Filed: Dec. 3, 2019

(65) Prior Publication Data

US 2020/0283224 A1 Sep. 10, 2020

(30) Foreign Application Priority Data

Dec. 4, 2018 (IT) ..... 102018000010768

(51) Int. Cl.
*B65D 85/10* (2006.01)
*B65B 19/12* (2006.01)

(52) U.S. Cl.
CPC ..... *B65D 85/1072* (2013.01); *B65B 19/12* (2013.01); *B65D 85/1081* (2013.01)

(58) Field of Classification Search
CPC ..... B65D 5/48; B65D 5/4802; B65D 5/4803; B65D 25/04; B65D 77/02; B65D 85/10; B65D 85/1072; B65D 85/1081
USPC ..... 206/256–258
See application file for complete search history.

(56) References Cited

U.S. PATENT DOCUMENTS 2,346,788 A * 4/1944 Rice ..... B65D 5/48036 217/28
3,596,758 A * 8/1971 Phillips, Jr. ..... B65D 77/02 206/256
3,721,335 A * 3/1973 Grant ..... B65D 5/4803 206/256

* cited by examiner

*Primary Examiner* — Bryon P Gehman
(74) *Attorney, Agent, or Firm* — Marshall, Gerstein & Borun LLP

(57) ABSTRACT

A spacer support for packets of smoking articles includes a plurality of through housing compartments to receive at least one packet and having a pair of apertures on opposite sides for introducing or extracting the packets, and wherein the spacer support also includes a pair of lateral walls having a plurality of opposite windows, and a pair of connection walls which extend between the connecting lateral walls. A plurality of positioning elements and a plurality of access openings are disposed alternately one after the other, in succession in the longitudinal direction, so that each housing compartment is delimited by the pair of opposite lateral walls and by the positioning elements so as to stably retain the packets in a static manner relative to the longitudinal direction.

15 Claims, 5 Drawing Sheets

10
11
13
14
15
15A
15B
17
18
20
22
100
101
102
103
104
110
D
X
Y
Z

SPACER SUPPORT FOR PACKETS OF SMOKING ARTICLES, SPACER KIT AND PACKAGE CONTAINING SAID SPACER KIT

FIELD OF THE INVENTION

The present invention concerns a spacer support for packets of smoking articles. The spacer support is in particular configured to receive a plurality of packets of smoking articles disposed in an ordered manner.

The present invention also concerns both a kit formed by said spacer support and the plurality of packets received therein, and a box-like package which encloses the spacer support with the packets, and also the method for assembling said kit.

BACKGROUND OF THE INVENTION

According to current legislation, smoking articles are subject to special taxation by government authorities. This taxation regime applies both to traditional smoking articles, such as cigarettes, cigars, cigarillos, tobacco cut for cigarettes, and to electronic cigarettes, that is, those inhalers or vaporizers that do not provide for the direct combustion of tobacco.

From a practical point of view, the tax on these articles takes the form of the application of a government stamp on the outside of the packet containing the smoking articles.

There are many methods for applying the government stamp, which vary according to the national legislation concerned.

In many countries the government stamp is applied to the packet directly by the producer of the smoking articles. To this end, the manufacturer is equipped with the appropriate devices to apply the stamp on the packet, after it has been formed and closed around an organized group of smoking articles. Sometimes, the automatic packaging machine itself has a processing station dedicated to applying the stamp. In this case, the station for applying the stamp is built according to the needs of the manufacturer, and is designed and sized based on the specific type of packets processed by that particular packaging machine.

In other countries, on the contrary, the legislation provides that the government stamp is directly applied to the packets by the competent government agency. This means that the producer of smoking articles, after having produced and packaged them, sends them to the government site for the application of the stamp. Here, the box-like packages that enclose the packets are temporarily opened and disposed on a printing machine, in which special printheads apply the stamps on the packets. Subsequently, the packages are closed and returned to the manufacturer for subsequent marketing.

One disadvantage of the procedure for applying the stamp by the government agency, and not by the producer of the smoking articles, is that it is long and expensive, in terms of time and money.

One example of a box-like package for packets of smoking articles suitable to be subjected to the procedure for applying the government stamp as above is described by U.S. Pat. No. 4,932,534.

This prior art document describes a blank, wrapped around a plurality of packets for smoking articles. The blank is shaped so as to define two compartments for housing the packets, which are joined to form two adjacent rows of packets. U.S. Pat. No. 4,932,534 provides that the blank is formed so that the two different housing compartments can be separated from one another if necessary to define two half-packages which each receive half of the packets overall housed in the blank, that is, a row of five packets.

In each housing compartment the packets are disposed adjacent so that the respective lateral walls are in reciprocal contact, leaving a bottom wall of the packets exposed on which the government stamp is affixed, after the resealable flaps of the box-like package containing the blank and packets have been opened.

To overcome this disadvantage, trying to make the application step of the government stamp quicker and easier, another package for packets for smoking articles has been developed, described by U.S. Pat. No. 5,351,820.

The package described in this document comprises a plurality of openings, or notches, made directly on the package which encloses the packets in correspondence with the bottom wall on which the government stamp is to be affixed. In this way, the latter can be applied without needing to open a box-like casing disposed around the package in which the packets are disposed.

One disadvantage of this package is that the notches weaken the structure.

Since the position of the printheads is fixed in government printing machines, they are able to correctly apply the government stamp only on a single type of packet for smoking articles, having a parallelepiped shape and standard sizes. For example, the standard sizes of the top wall, or the bottom wall, on which the stamp is usually applied, are 22.5×56 mm.

One disadvantage encountered during the process of applying the government stamp using the printing machines known in the state of the art is that they are not able to correctly affix the stamp in the position provided on a group of special packets, for example having sizes different from the standard ones indicated above.

At present, blanks or packages known in the state of the art are not able to support the packets for smoking articles during the procedure for applying the government stamp in an efficient and flexible manner. In fact, the blanks and packages known in the state of the art are not suitable to support special packets, that is, having different sizes from the standard ones, and at the same time to guarantee the correct execution of the step of applying the government stamp.

Another example of a spacer support for packets for smoking articles to distance and protect packets having sizes smaller than the standard ones is described in the U.S. Pat. No. 3,721,335. Also known in the state of the art are other types of packages made of cardboard or similar materials in which different cells are made, separated from one another, to accommodate an article. One example of this type of package is described in U.S. Pat. No. 2,690,866.

There is therefore the need to make available a spacer support for packets for smoking articles, which can overcome at least one of the disadvantages of the state of the art.

One purpose of the present invention is to provide a spacer support for packets for smoking articles which allows the packets to be held firmly in position during one or more processing steps and/or during transport and storage. It is therefore a purpose of the present invention to provide a spacer support for packets of smoking articles able to support the packets at least during the procedure for applying, or printing, the government stamp on them.

Another purpose of the present invention is to provide a spacer support able to keep the packets positioned in an ordered manner inside a box-like package.

Another purpose of the present invention is to provide a spacer support able to support "special" packets, that is, having different sizes from standard packet sizes.

It is also a purpose of the present invention to provide a spacer support thanks to which it is possible to use the same equipment known in the state of the art, in particular the same printing machines, also for applying the government stamp on "special" packets having different sizes and/or or shapes than the standard ones.

Another purpose of the present invention is to provide a spacer support for packets of smoking articles which is economical and simple to make.

The Applicant has devised, tested and embodied the spacer support for packets of smoking articles according to the present invention, the kit and the box-like package that make it up, also perfecting the method for assembling a spacer kit according to the principles of the present invention, to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

Embodiments described here concern a spacer support for packets for smoking articles configured to support a plurality of packets in an ordered manner. In accordance with one embodiment, the spacer support comprises a plurality of housing compartments each intended to receive at least one packet and disposed in succession in a longitudinal direction.

According to embodiments provided here, each housing compartment comprises a pair of access apertures through which the packets can be introduced into the respective housing compartment, or extracted therefrom, where the apertures are disposed on opposite sides one with respect to the other so as to define a through housing compartment, having both ends open, to allow the packets to pass.

According to embodiments provided here, the spacer support comprises a pair of opposite lateral walls, each able to be contacted by a respective wall of the packet, and a pair of opposite connection walls which extend between the lateral walls to reciprocally connect the latter.

In one embodiment, a plurality of access apertures are made on the connection walls, separated by a plurality of positioning elements, the latter able to contact a respective wall of the packet when disposed inside a pair of opposite access apertures so that, in cooperation with the opposite lateral walls, the positioning elements delimit the housing compartments to stably hold the packets inside them in a static manner, in the longitudinal direction. In some embodiments, each lateral wall comprises a plurality of windows disposed facing each other on the respective lateral walls so as to define through cavities extending in a transverse direction, in particular perpendicular to the longitudinal direction as above, the windows being intended to receive guide means configured to interact with the spacer support during the introduction of the packets into the respective housing compartments. In particular, the windows are intended to be passed through by the guide means, which pass through the spacer support from one side to the other in order to keep its shape stable during the introduction of the packets, and at the same time to act as guide means which laterally delimit the housing compartments.

According to embodiments provided here, each lateral wall comprises a plurality of windows, each pair of windows being disposed substantially aligned with at least one respective positioning element made in the connection walls as above, and extends in a longitudinal direction for an extension substantially equal to that of the respective at least one positioning element aligned with it.

In one embodiment, on each connection wall the access apertures and the positioning elements are disposed alternately one after the other, in succession in the longitudinal direction, perpendicular to the transverse direction as above.

According to embodiments provided here, the positioning elements are made on the connection walls one after the other at a distance, measured in said longitudinal direction, equal to a predetermined and constant value, so as to dispose and retain the packets in the respective housing compartments at a constant pitch between them, coordinated with the distance as above.

According to embodiments provided here, also the windows are made on the lateral walls one after the other at a distance, measured in said longitudinal direction, equal to a predetermined and constant value, substantially equal to the distance between two consecutive positioning elements.

According to one embodiment, the positioning elements are disposed parallel to the transverse direction, perpendicular to the longitudinal direction, to reciprocally connect the lateral walls.

In accordance with embodiments provided here, the connection walls comprise an upper wall in which a first group of positioning elements and access apertures is made, and a lower wall in which a second group of positioning elements and access apertures is made.

In one embodiment, each pair of facing windows on the respective lateral walls is aligned in the longitudinal direction with a positioning element of the first group, made on the upper connection wall and with a positioning element of the second group, made on the lower connection wall.

In some embodiments, the positioning elements of the two different groups connect the lateral walls in correspondence with two different connection zones, respectively disposed in correspondence with an upper end edge and a lower end edge of the lateral walls, and the access apertures of the two different groups are disposed some in proximity to said upper end edge and the others in proximity to said lower end edge, in which an access aperture of the first group is coupled and aligned with an access aperture of the second group so as to define the opposite ends of the same housing compartment.

According to one embodiment, the opposite lateral walls, the upper wall and the lower wall are integrated in a single body, and are separated, one from the other, by pre-creasing or folding lines, which extend parallel to the longitudinal direction and which define an equal number of hinging lines along which the walls can fold, in particular by about 90°, with respect to the walls adjacent to them.

In one embodiment, the spacer support comprises a junction flap configured to receive an adhesive substance by means of which it is intended to be stably associated with one of the walls comprised in the spacer support, in particular with one of the lateral walls, so that the spacer support assumes a closed tubular shape.

According to another aspect of the present invention, a spacer kit for packets for smoking articles is provided, configured to support in an ordered manner a plurality of packets for smoking articles, comprising a plurality of packets, each having the shape of a parallelepiped and comprising two opposite lateral walls of greater extension, two opposite lateral walls of lesser extension, a lower wall and a top wall, and a spacer support in accordance with the embodiments described above.

In accordance with some embodiments of the kit according to the present invention, each housing compartment is configured to receive two coupled packets so that respective lateral walls of greater or lesser extension are reciprocally overlapping. Moreover, the packets are received in the respective housing compartments so that the lower wall and the top wall remain exposed and easily accessible directly from the outside in correspondence with the respective access aperture.

According to one embodiment of the spacer kit according to the present invention, each lateral wall of the spacer support is able to be contacted by a respective lateral wall of greater extension of the packet, while the positioning elements are able to contact the lateral walls of lesser extension of the packet.

In one embodiment of the spacer kit according to the present invention, the distance described above is at least equal to or greater than a characteristic size of the packet, measured in the longitudinal direction, for example defined as the extension in said longitudinal direction of the lateral walls of greater and lesser extension.

According to another aspect of the present invention a method is provided for assembling a spacer kit according to the present invention, comprising the steps of:

making available a spacer support having a tubular shape and provided with a plurality of housing compartments to each receive one or more packets for smoking articles, introducing an ordered group of packets of smoking articles inside the housing compartments by means of thruster means, during the introduction step, engaging with guide means a plurality of windows made on at least one lateral wall of the spacer support to guide the introduction of the packets into the respective housing compartments and to maintain in a stable manner the tubular shape of the spacer support during the introduction step.

In one embodiment, the spacer support is made available to the packaging machine which assembles the already formed spacer kit, in a flattened or flat configuration, which must be previously opened, in a processing station of the packaging machine, to give the spacer support said tubular shape as above.

According to alternative embodiments, it is provided to feed an extended blank to the packaging machine, which is subsequently folded along pre-creasing or folding lines which extend parallel to a longitudinal direction, in which on at least one wall or flap comprised in the blank an adhesive substance is deposited, so as to allow the wall or flap to remain stably associated with another wall of the blank to give the spacer support the tubular shape as above.

One advantage of the spacer support, the kit and the box-like package which comprise it, in accordance with the principles of the present invention, is that it firmly retains an ordered group of packets of smoking articles in the desired position, for example according to a configuration which provides to dispose the packets in a row.

Another advantage of the spacer support according to the present invention is that it allows the packets to be kept distanced from one another in the longitudinal direction by a desired constant distance.

One advantage of the spacer support according to the present invention is therefore that it defines "centering" means thanks to which each packet is located in correspondence with a desired reference position. It is clear that this is particularly advantageous because it facilitates the automatic execution of processing steps that must be performed on the packets. For example, thanks to the spacer support according to the present invention, the step of applying a government stamp on one of the walls of the packets for smoking articles can be carried out by means of printing machines that are known in the state of the art, regardless of the size and shape of the packets, without these machines needing particular adaptations or preliminary adjustments.

Disposing the packets for smoking articles in a spacer support according to the present invention is therefore advantageous because it allows to process any "special" packet, regardless of its size, in the same way as a "standard" or traditional packet, so that it can be processed by most, or all, of the equipment and machinery used in the field of smoking articles, without needing lengthy and laborious adaptation or set-up operations, and above all without requiring the purchase of special machinery able to work only a particular packet format. To facilitate this, the positioning elements can be suitably sized in a coordinated way with the sizes of the "special" packets on which the government stamp has to be applied, for example by ensuring that the constant distance as above is equal to or greater than a characteristic size of the packet, and also equal to one of the characteristic sizes of traditional packets, for example equal to 56 mm.

Another advantage of the spacer support according to the present invention is that it is economical and easy to make.

Another advantage of the spacer support according to the present invention is that it is sturdy and resistant.

A further advantage of the spacer support according to the present invention is that it is light and compact, which is important so as not to significantly increase transport and storage costs which are typically proportional to the weight and/or volume of the objects to be transported or stored.

Another advantage of the spacer support according to the present invention is that it is ecological because, thanks to the fact that it is preferably made of cardboard, without any type of insert made of different materials, it can be considered differentiable waste which can be recycled after use.

A further advantage of the spacer support according to the present invention is that it does not spoil the kit according to the present invention from an aesthetic point of view. In fact, since the spacer support is configured to remain inside the box-like package even when it is distributed and marketed, it is obvious that the fact that the spacer support is not unpleasant to the eye is advantageous.

One advantage of the method for assembling a spacer kit according to the present invention is that it is intuitive, simple to implement and has reduced cycle times which allow the kit to be assembled more rapidly than in the state of the art.

Another advantage of the method for assembling a spacer kit according to the present invention is that it is reliable since, thanks to the presence of the guide means which engage with the windows made on the lateral walls, the packets are introduced correctly into the respective housing compartments. In this way, it is possible to prevent unwanted relative movements between the spacer support and the packets which are being introduced into the housing compartments from leading to misalignments between the support and the packets. Consequently, it is possible to prevent the packets which do enter correctly from one of the access apertures from then "swerving" and getting stuck inside the spacer support, without being able to pass through the other access aperture, opposite the first access aperture through which the packets have been introduced.

These and other aspects, characteristics and advantages of the present disclosure will be better understood with reference to the following description, drawings and attached claims. The drawings, which are integrated and form part of the present description, show some embodiments of the present invention, and together with the description, are intended to describe the principles of the disclosure.

The various aspects and characteristics described in the present description can be applied individually where possible. These individual aspects, for example aspects and characteristics described in the attached dependent claims, can be the object of divisional applications.

It is understood that any aspect or characteristic that is discovered, during the patenting process, to be already known, shall not be claimed and shall be the object of a disclaimer.

DESCRIPTION OF THE DRAWINGS

These and other characteristics of the present invention will become apparent from the following description of some embodiments, with the connected modalities, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DESCRIPTION OF SOME EMBODIMENTS

Figure 1:
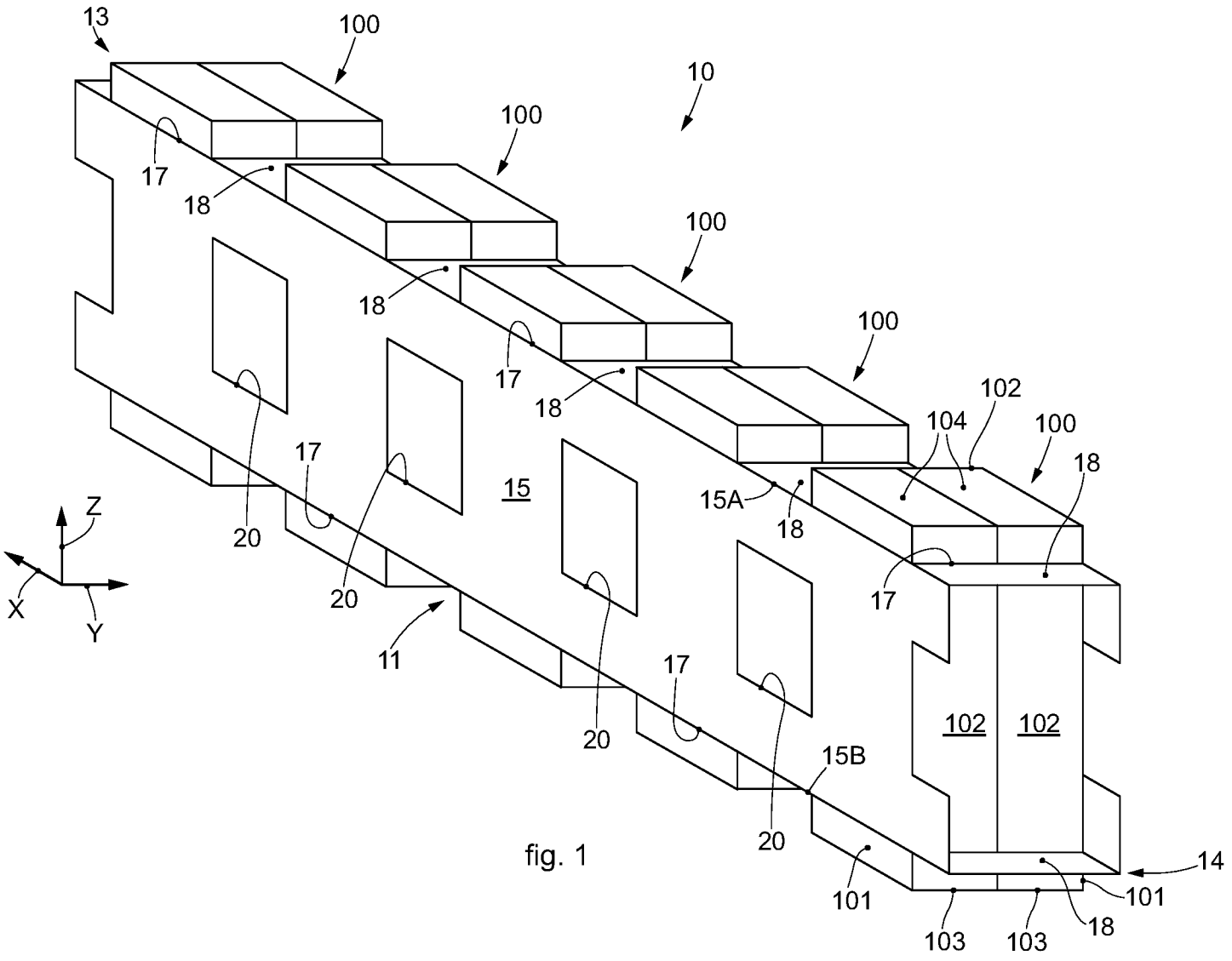
FIG. 1 is a perspective and schematic view of a kit according to the present invention comprising a spacer support for packets of smoking articles, and a plurality of packets housed in the spacer support.

We will now refer in detail to the various embodiments of the present invention, of which one or more examples are shown in the attached drawings. Each example is supplied by way of illustration of the invention and shall not be understood as a limitation thereof. For example, the characteristics shown or described insomuch as they are part of one embodiment can be adopted on, or in association with, other embodiments to produce another embodiment. It is understood that the present invention shall include all such modifications and variants.

Embodiments described here with reference to the drawings concern a spacer kit for packets of smoking articles, indicated as a whole by the reference number 10.

The spacer kit 10 comprises a spacer support 11 and a plurality of packets for smoking articles, indicated as a whole by the reference number 100.

As best seen in FIGS. 1-4, each packet 100 has the shape of a rectangular-based parallelepiped and comprises two opposite lateral walls of greater extension 101, two opposite lateral walls of lesser extension 102, a lower wall 103 and a top wall 104.

In one embodiment, purely by way of non-restrictive example, the sizes of a packet 100 suitable to be supported by the spacer support 11 can be equal to 22.5×28.5 mm, meaning with these values respectively the width and the height of the lower wall 103, which defines the base of the parallelepiped, that is, also those of the top wall 104.

In an alternative embodiment, each packet 100 has the shape of a parallelepiped with a square base, in which the lateral walls of greater and lesser extension 101, 102 have the same extension, as do the lower wall 103 and the top wall 104.

According to embodiments described here, the spacer support 11 comprises five housing compartments 12 disposed in succession one after the other in a longitudinal direction X.

Each housing compartment 12 is configured to receive a corresponding pair of packets of smoking articles 100, disposed in such a way that respective lateral walls of greater extension 101 of each packet 100 are in reciprocal contact, completely overlapping one another.

In a preferred embodiment, the housing compartments 12 each receive a pair of packets 100.

In particular, the housing compartments 12 define a configuration according to which five packets 100 are each disposed in a respective housing compartment 12 to form a row which develops parallel to the longitudinal direction X, and another five packets 100, each coupled with a respective packet 100 inside a corresponding housing compartment 12, form a second row, parallel to the previous one and to the longitudinal direction X.

In some embodiments, the spacer support 11 comprises a pair of lateral walls 15 and a pair of connection walls 13, 14 which extend between the lateral walls to reciprocally connect the latter. According to these embodiments, the lateral walls 15 are opposite each other, parallel to each other, and alternate with the two connection walls 13, 14, which are also opposite and parallel. In other words, the spacer support 11 has a tubular shape having a substantially rectangular cross-section, in which for example the two long sides of the rectangle are the lateral walls 15 and the two short sides of the rectangle are the connection walls 13, 14 as above.

A plurality of positioning elements 18 are made on the connection walls 13, 14, which follow one after the other, equidistant in the longitudinal direction X.

The positioning elements 18 connect the pair of lateral walls 15 and extend parallel to a transverse direction Y, substantially perpendicular to the longitudinal direction X.

According to one embodiment, a first group of positioning elements 18 is provided, made on a connection wall 13, in particular formed by six of these elements, and a second group of positioning elements 18 made on the other connection wall 14, also formed by six elements. The positioning elements 18 of the two different groups connect the lateral walls 15 to each other above and below, respectively in correspondence with an upper end edge 15A and a lower end edge 15B. In a particular embodiment, in each of said groups, four positioning elements 18 are interposed between two adjacent packets 100, and the remaining two positioning elements 18 are disposed at opposite ends of the lateral wall 15, so as to retain the outermost packet 100 disposed at the end of the row.

The positioning elements 18 comprised in the first group all lie on the same plane, defined by the upper connection wall 13 of the spacer support 11 and passing through the two upper end edges 15A of the lateral walls 15, while also the positioning elements 18 comprised in the second group all lie on the same plane, different from the previous one, defining a lower connection wall 14 of the spacer support 11 and passing through the two lower end edges 15B of the lateral walls 15.

It should be noted that each housing compartment 12 is delimited, in the transverse direction Y, by the pair of lateral walls 15 which each contact one of the lateral walls of greater extension 101, and, in the longitudinal direction X, by a plurality of positioning elements 18 which respectively contact opposite lateral walls of lesser extension 102. In particular, each compartment is delimited by a pair of positioning elements 18 of the first group, lying on the upper wall 13, and by a pair of positioning elements 18 of the second group, lying on the lower wall 14. Thanks to the pair of walls 15 and to the positioning elements 18, each housing compartment 12 firmly and stably retains each pair of packets 100, preventing any movement thereof, both in the transverse direction Y and in the longitudinal direction X. In other words, in correspondence with the positioning elements 18, a separation interspace is defined between two pairs of adjacent packets 100.

In embodiments provided here, the positioning elements 18 are disposed one after the other at a distance D, measured in the longitudinal direction X, which is equal to a predetermined and constant value, so as to dispose and retain the packets 100 in the respective housing compartments 12 at a constant pitch between them, coordinated with said distance D.

In a preferred embodiment, the distance D is equal to one of the characteristic sizes of the standard packets for smoking articles, for example equal to 56 mm.

The positioning elements 18 are sized so as to extend, in the longitudinal direction X, for an extension which is complementary to the extension of the top wall 104 and the lower wall 103 of each packet 100 measured in this same direction, so that the sum of the overall sizes, measured in the longitudinal direction X, of a positioning element 18 and of the packet 100 adjacent to it is equal to the distance D as above.

In other words, in this embodiment, if the top wall 104 and the lower wall 103 of each packet 100 have an extension, measured in the longitudinal direction X, of about 28 mm, then the positioning elements 18 interposed between two pairs of packets 100 are sized so as to extend in this same direction, approximately for another 28 mm, so that the sum gives the 56 mm of the distance D as above. It should be noted that the two positioning elements 18 disposed at opposite ends of the spacer support 11 have an extension in the longitudinal direction X which is about half the extension of the other positioning elements 18 which are interposed between two pairs of packets 100.

Figures 2, 3A, 3B, 4:
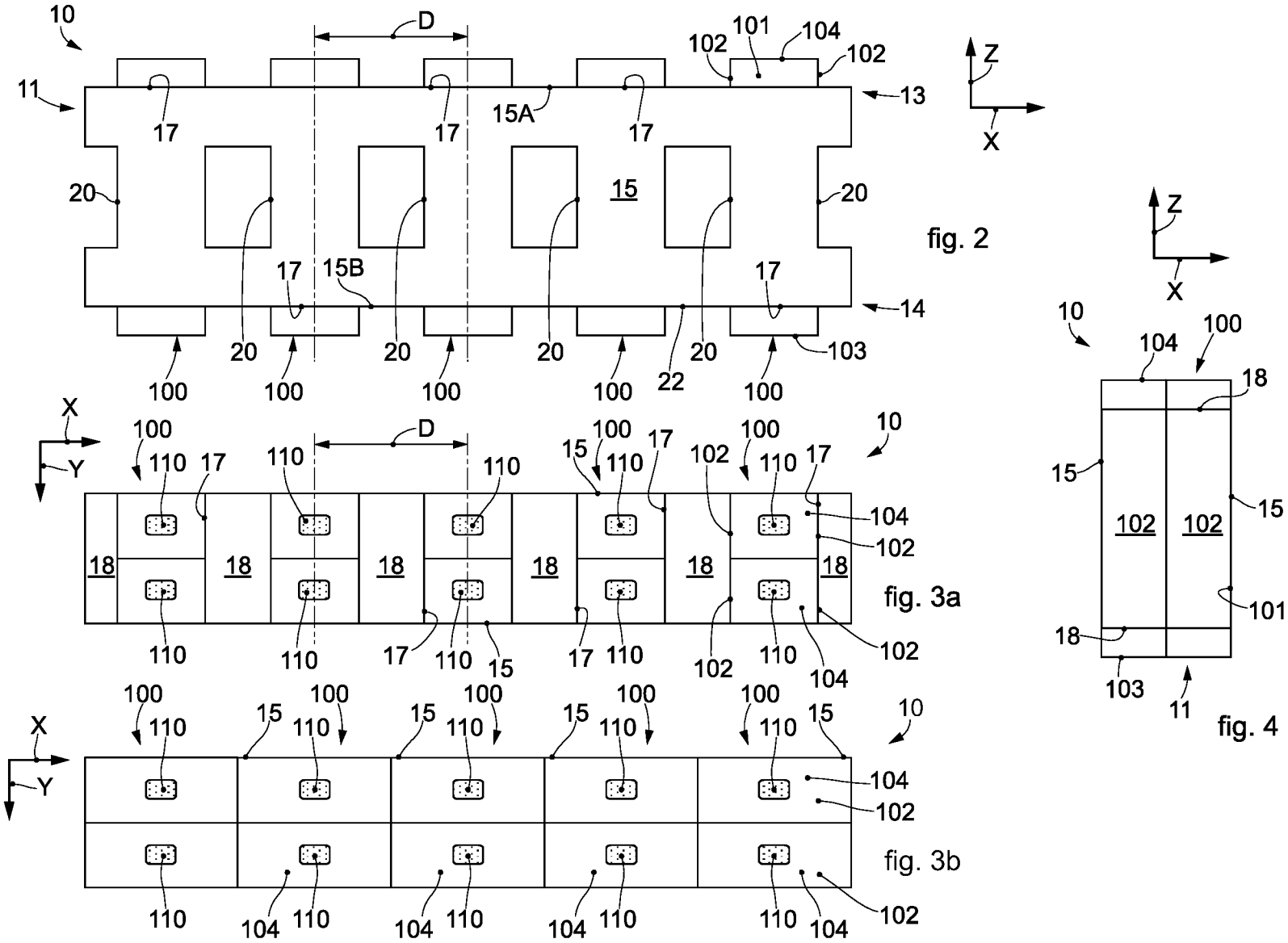
FIG. 2 is a lateral elevation view of the kit in FIG. 1.
FIGS. 3*a*-3*b* are plan views respectively of the kit in FIG. 1 according to the present invention and a group of traditional packets for smoking articles.
FIG. 4 is a front elevation view of the kit in FIG. 1.

Each housing compartment 12 is through and develops in a direction of development Z which is perpendicular to both the transverse direction Y and the longitudinal direction X, defining with the latter a set of three Cartesian axes. As shown in FIGS. 1, 2 and 4, the spacer support 11 is configured to receive the packets 100 in the housing compartments 12 according to a configuration such that the packets 100 protrude, at the upper and lower part, above and below the upper end edge 15A and lower end edge 15B of the lateral walls 15. In this way, both the lower wall 103 and the top wall 104 of the packets 100 remain exposed and easily accessible to carry out the necessary processes on them, such as for example the application of the government stamp.

Each housing compartment 12 therefore comprises two access apertures 17 through which the packets 100 can be indifferently introduced or withdrawn from the housing compartment 12.

According to some embodiments, each lateral wall 15 comprises a plurality of windows 20, for example of a substantially rectangular shape. In one embodiment, each window 20 is disposed substantially aligned with at least one respective positioning element 18, as best seen in the flat development of FIG. 5. Furthermore, each window 20 extends in the longitudinal direction X substantially for an extension equal to that of the respective positioning element 18 aligned with it, for example equal to about 28 mm. As will be described in greater detail below, in the description of a method for assembling a spacer kit according to the present invention, the windows 20 are configured to be passed through by guide means 106 which guide the introduction of the packets 100 into the housing compartments 12 in the transverse direction Y.

In the embodiment shown, in which four positioning elements 18 are provided interposed between consecutive pairs of packets 100, an equal number of windows 20 are provided.

Furthermore, the windows 20 lighten the overall weight of the spacer support 11.

Figure 5:
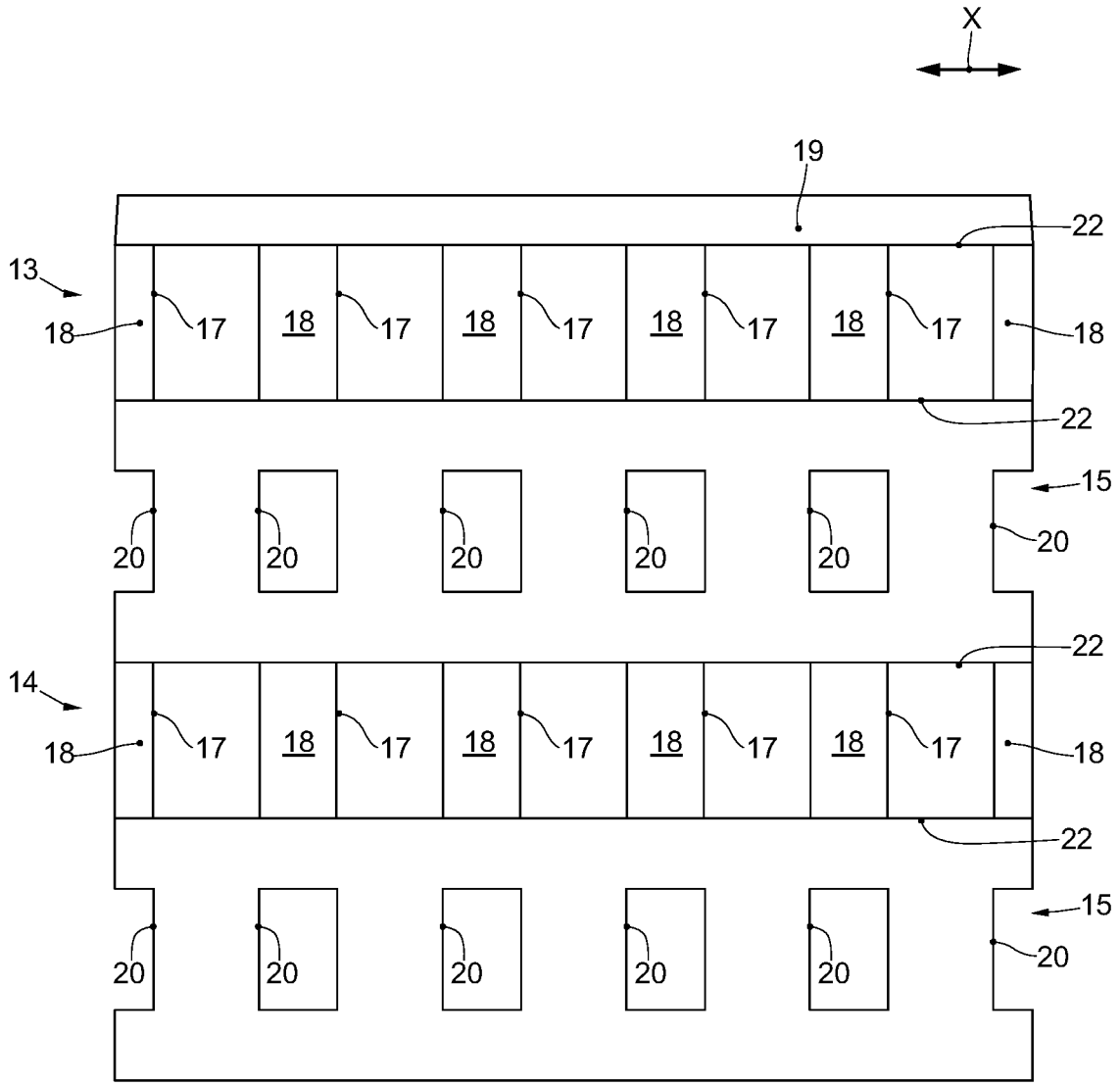
FIG. 5 is a plan view from above showing the flat development of one embodiment of a spacer support according to the present invention.

With reference to FIG. 5, the flat development of a spacer support 11 according to the present invention, for example in accordance with one of the embodiments described above, is visible.

The spacer support 11 comprises pre-creasing or folding lines 22, which extend parallel to the longitudinal direction X and which separate the lateral walls 15 from the upper wall 13 and the lower wall 14 in which the positioning elements 18 and the access apertures 17 are made The pre-creasing lines 22 define an equal number of hinging lines that allow the walls to fold, for example by about 90°, with respect to the adjacent wall.

In one embodiment, the lateral walls 15, the upper wall 13 and the lower wall 14 are made in a single body.

It will be noted that the folding lines 22 which separate the lateral walls 15 from the upper wall 13 define the upper end edges 15A of the lateral walls 15, while the folding lines 22 which separate the lateral walls 15 from the lower wall 14 define the lower end edges 15B of the lateral walls 15.

The spacer support 11 also comprises a junction flap 19, for example joined to the upper wall 13 along a folding line 22. The junction flap 19 is configured to receive an adhesive substance, for example in correspondence with a plurality of points homogeneously distributed on it, or in the form of an adhesive strip which extends over the entire longitudinal extension of the junction flap 19. During the forming operations of the spacer support 11, it is provided to fold the walls along the folding lines 22, so as to define a tubular-shaped element by joining the junction flap 19, on which the adhesive substance has previously been disposed, with the opposite lateral wall 15.

In one embodiment, also the junction flap 19 is made in a single body with the walls 13, 14, 15.

According to the various embodiments described here, the spacer support 11 is made starting from sheet material, for example made of paper, cardboard or thin cardboard.

In other embodiments, the spacer support 11 can also be made of materials other than those mentioned above, such as for example plastic.

The spacer kit 10 described above is configured to be introduced into a box-like package 23 (FIG. 7) having a body 24 configured to receive the spacer kit 10 (that is, the spacer support 11 and the plurality of packets 100) which can be closed in a reclosable manner by a lid 25 formed by two flaps 25A, 25B hinged to the body 24.

The flaps 25A, 25B can be opened to have access inside the box-like package 23, for example to remove the packets 100 or to perform on them one or more processes, such as the application of the government stamp, and subsequently closed to close the box-like package 23.

In one embodiment, an external wrapping (not shown) is provided, wrapped around the box-like package 23. The external wrapping hermetically encloses the box-like package 23 and is applied at the end of all the processing operations, when the package is ready to be stored or sent for subsequent marketing. The external wrapping can for example consist of a thin and transparent film, for example made of polymeric materials known in the state of the art (cellophane or suchlike).

Figure 6:
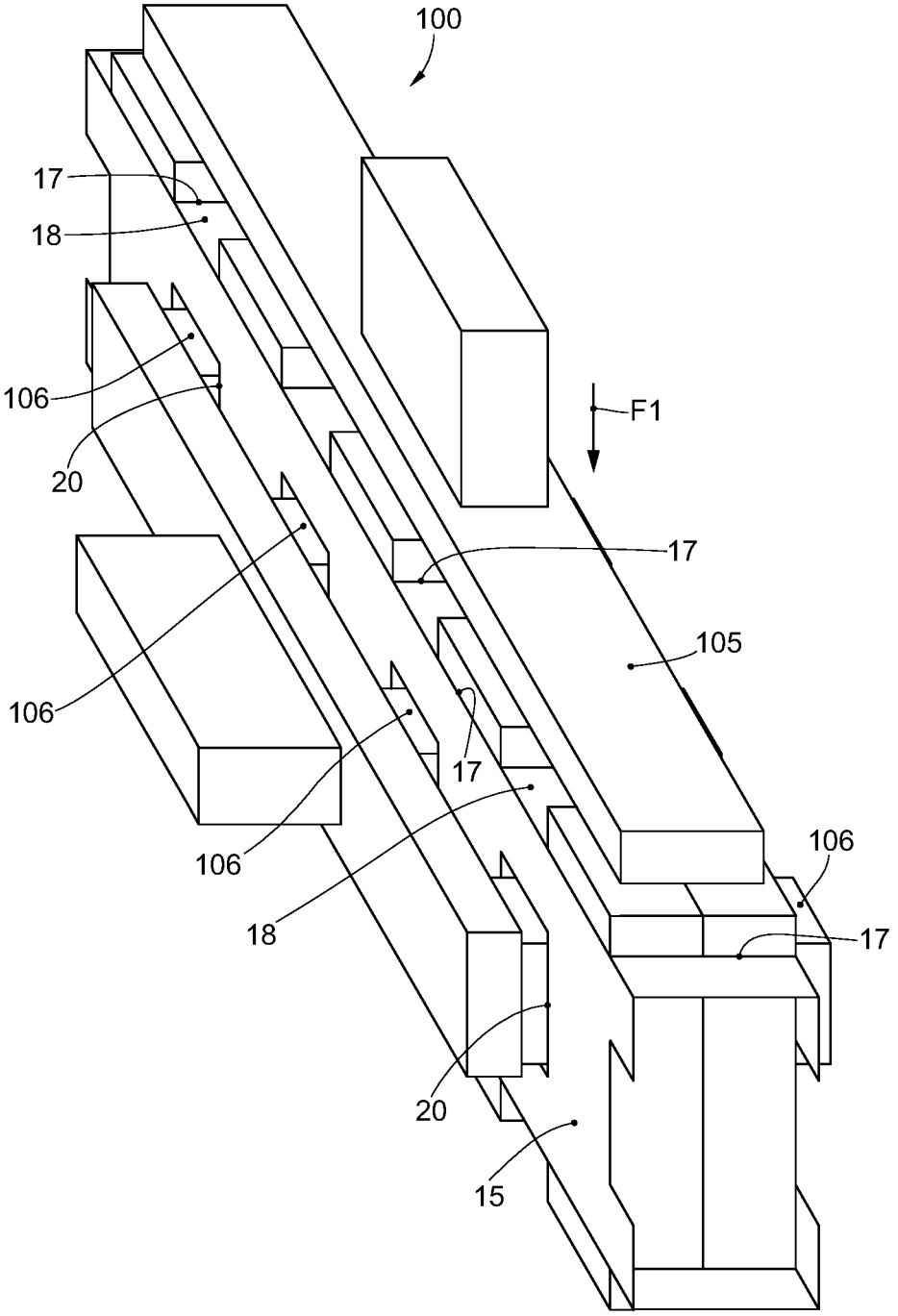
FIGS. 6 and 7 are perspective and schematic views showing a sequence of operating steps of a method for assembling the kit in FIG. 1, and disposing it inside a box-like package that surrounds it.
Figure 7:
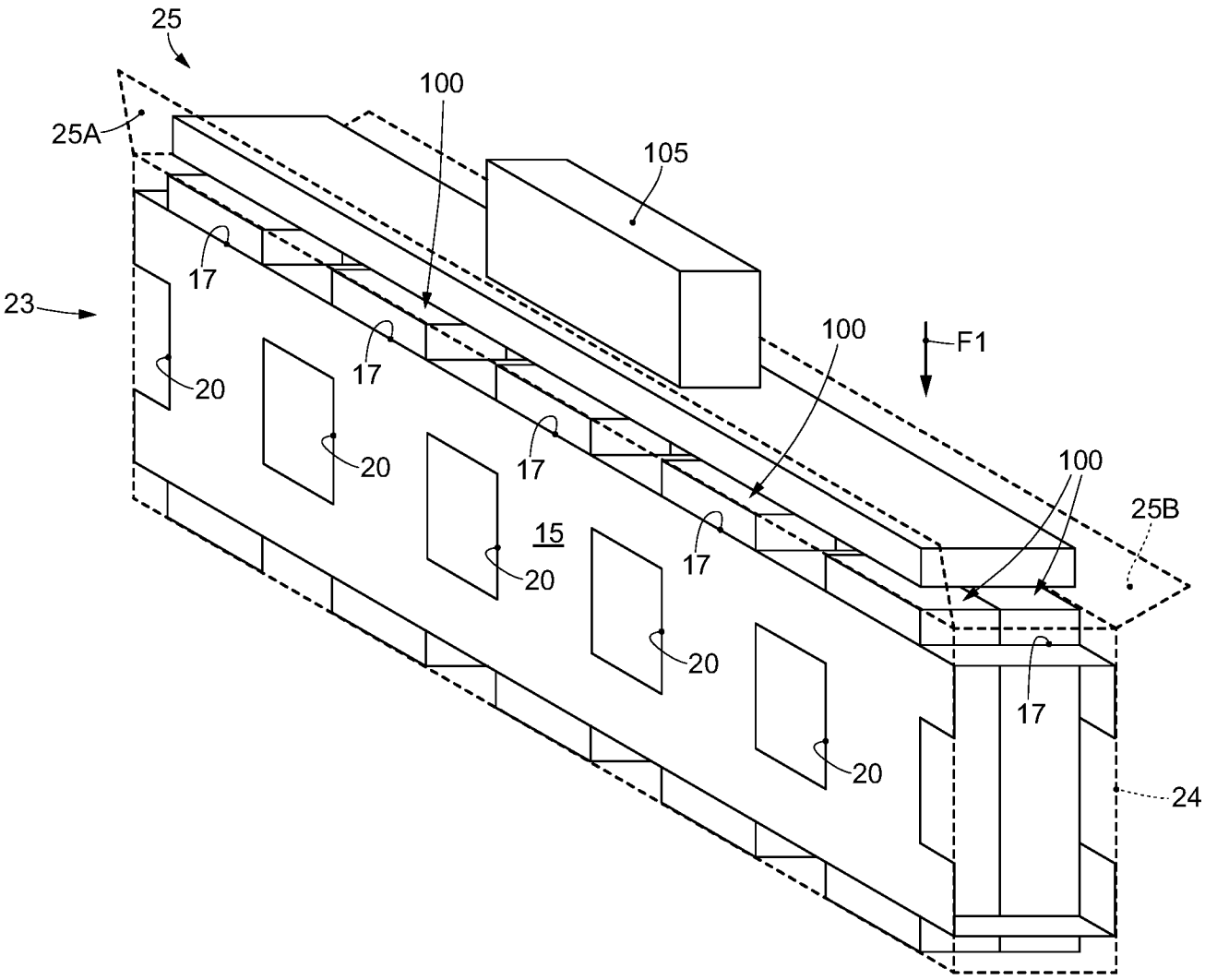

With reference to FIGS. 6 and 7 we will now describe a method for assembling a spacer kit 10 according to the present invention.

In a first step, it is provided to make available a spacer support 11 to a packaging machine that manages the assembly of the spacer kit 10.

In a preferred embodiment, the spacer support 11 is supplied to the packaging machine already shaped in the tubular shape as above, disposed in a flat or extended condition. The packaging machine provides a station for opening the support, in which the spacer support 11 is opened, by means of suitable mechanical members known in the state of the art, so as to give it the tubular shape visible in FIG. 1. In this configuration, the spacer support 11 is ready to receive the packets 100.

In a variant embodiment, it is provided to supply the spacer support 11 to the packaging machine in the version shown in FIG. 5, that is, as a flat blank not yet shaped in the closed tubular shape as above. In this case, the packaging machine can comprise a station in which it is provided to dispose the adhesive substance on the junction flap 19 and then make the latter adhere to the opposite lateral wall 15 (at the bottom in FIG. 5), compressing it against the wall to give the spacer support 11 the closed tubular shape as above.

In a second step, it is provided to introduce an ordered group of packets 100, coupled in groups of two, inside the housing compartments 12 by the action of one or more thrust members 105. As indicated by the arrows F1, the spacer support 11 is preferably kept stationary, while the thrust members 105 move the group of packets 100 toward it.

During the second introduction step, the method also provides to insert a plurality of guide members 106 into respective windows 20. The guide members 106, which act as a guide for introducing the packets 100, allow the spacer support 11 to be held stationary, during the introduction of the packets 100. The guide members 106 are configured to penetrate inside the windows 20 on the opposite lateral walls 15, so as to completely pass through the spacer support 11 parallel to the transverse direction Y, and prevent unwanted relative movements of the spacer support 11 and the packets 100. In this way, thanks to the guide members 106 it is possible to keep the shape of the spacer support 11 stable, so that the packets are correctly aligned with the respective housing compartments 12. In this way, the guide members 106 guarantee the correct introduction of the packets 100 into the through housing compartments 12, in the vertical direction Z, preventing unwanted misalignments of the packets 100 which are being introduced and the opposite access apertures 17.

Once the introduction of the packets 100 into the housing compartments 12 has been completed, it is provided to retract the guide members 106 and to insert the spacer kit 10, formed by the spacer support 11 and the packets 100 received in it, inside the box-like package 23.

In one embodiment, schematically shown in FIG. 7, the introduction of the spacer kit 10 into the box-like package 23 is carried out by means of the same thrust members 105 which introduce the packets 100 into the housing compartments 12.

With reference to FIGS. 3*a* and 3*b*, we will now briefly illustrate one way of using the spacer support 11 and kit 10 according to the present invention, with particular reference to the step of applying a government stamp, indicated by the reference number 110, on the packets 100 of smoking articles.

FIG. 3*b* shows an ordered group of traditional packets of smoking articles, ordered in two overlapping rows of five packets each.

FIGS. 3*a*-3*b* make it possible to compare, visually, immediately and intuitively, the situation presented by using a spacer support 11 according to the present invention which receives a plurality of "special" packets 100, having smaller sizes than the standard sizes of traditional packets (FIG. 3*a*), in comparison with the situation occurring in the state of the art, in which the government stamp 110 must be applied on a group of traditional packets of smoking articles, without the spacer support 11 (FIG. 3*b*).

As can be seen from the comparison between the drawings, the outermost profile of the spacer support 11 delimits an area that is identical to the overall area occupied by the group of traditional packets. In other words, the spacer support 11 is shaped and sized so as to compensate for the lower volumes occupied by the "special" packets so that the latter, when received by the spacer support 11, substantially occupy the same volumes as a group of traditional packets.

Moreover, from the comparison between the drawings it is also possible to see that the position of the government stamps remains unchanged in both cases. Thanks to the presence of the spacer support 11, the two-dimensional spatial "coordinates" in the directions X and Y of the government stamps 110 applied on the packets 100 remain identical to the corresponding "coordinates" of the homologous government stamps applied on traditional packets for smoking articles.

As shown in FIGS. 3*a*-3*b*, the distance, or interaxis, between the center of two government stamps 110 applied on two adjacent packets 100 is substantially equal to the distance D in the longitudinal direction X.

It is evident that the shapes, the sizes and the thicknesses cited in the present description are given merely by way of example, and can be modified, without departing from the field of protection of the present invention, depending on the sizes and shapes of the packets of smoking articles to be received in the spacer support 11. In fact, as can be seen from the description of the comparison between FIGS. 3*a* and 3*b* above, the spacer support 11 has sizes and thicknesses correlated, in particular complementary, to those of the packet 100 which it has to support, in order to maintain the same overall volumes of a group of traditional packets and to dispose the packets in positions such that the government stamp can be applied in the same positions (or "coordinates") with respect to the conventional case.

It is clear that modifications and/or additions of parts or steps may be made to the spacer support and kit as described heretofore, without departing from the field and scope of the present invention.

It is also clear that, although the present invention has been described with reference to some specific examples, a person of skill in the art shall certainly be able to achieve many other equivalent forms of spacer support and kit, having the characteristics as set forth in the claims and hence all coming within the field of protection defined thereby.

In the following claims, the sole purpose of the references in brackets is to facilitate reading: they must not be considered as restrictive factors with regard to the field of protection claimed in the specific claims.

The invention claimed is:

1. A spacer support for packets for smoking articles configured to support in an ordered manner a plurality of packets disposed in a row, and comprising:

a pair of opposite lateral walls, each able to be contacted by a respective wall of a packet; each of said lateral walls comprises a plurality of windows disposed along a longitudinal direction and facing each other on the respective lateral walls so as to define through cavities extending between two opposite windows, said windows being intended to receive guide means configured to interact with the spacer support during the introduction of the packets inside the respective housing compartments;

a pair of opposite connection walls that extend between said lateral walls in order to reciprocally connect said lateral walls, a plurality of access apertures on the connection walls, the access apertures separated by a plurality of positioning elements positioned to contact a respective wall of the packet when disposed inside an aligned pair of access apertures, where on each connection wall the access apertures and the positioning elements are disposed alternately one after the other, in succession in said longitudinal direction; so that, in cooperation with said opposite lateral walls, said positioning elements delimit housing compartments in order to secure the packets relative to the longitudinal direction;

where said positioning elements are made on said connection walls one after the other at a distance, measured in said longitudinal direction, equal to a predetermined and constant value, so as to dispose and hold the packets in their respective housing compartments at a constant pitch between them, coordinated with said distance.

2. The spacer support as in claim 1, wherein said positioning elements are disposed parallel to said, to reciprocally connect said lateral walls.

3. The spacer support as in claim 1, wherein said connection walls comprise an upper connection wall in which a first group of positioning elements and access apertures is made, and a lower connection wall in which a second group of positioning elements and access apertures is made.

4. The spacer support as in claim 3, wherein the positioning elements of the two different groups connect said lateral walls in correspondence with two different connection zones, respectively disposed in correspondence with an upper end edge and a lower end edge of said lateral walls, and the access apertures of the two different groups being disposed some in proximity to said upper end edge and others in proximity to said lower end edge, where an access aperture of the first group is coupled and aligned with an access aperture of the second group so as to define the opposite ends of the same housing compartment.

5. The spacer support as in claim 3, wherein said opposite lateral walls, said upper wall and said lower wall are integrated in a single body, and are separated from each other by pre-creasing or folding lines which extend parallel to said longitudinal direction and which define an equal number of lines along which said walls can be folded with respect to the walls adjacent to them.

6. The spacer support as in claim 3, wherein each pair of windows facing opposite each other on the respective lateral walls is aligned, in said longitudinal direction, with a positioning element of the first group, made on said upper connection wall and with a positioning element of the second group, made on said lower connection wall.

7. The spacer support as in claim 1, further comprising a junction flap configured to receive an adhesive substance by means of which it is intended to be stably associated with one of said walls comprised in the support spacer so that it assumes a closed tubular shape.

8. The spacer support as in claim 1, wherein each of said windows is disposed substantially aligned to at least one respective positioning element and extends in said longitudinal direction for an extension equal to that of the respective positioning element aligned with the window.

9. The spacer support as in claim 1, wherein said support is made starting from a sheet material made of cardboard.

10. A spacer kit for packets for smoking articles configured to support in an ordered manner a plurality of packets for smoking articles, comprising:

a plurality of packets for smoking articles, each having a parallelepiped shape and comprising two opposite lateral walls of greater extension, two opposite lateral walls of lesser extension, a lower wall and a top wall, and a spacer support comprising:

a) a plurality of housing compartments each intended to receive at least one of said packets, said plurality of housing compartments being disposed in succession along a longitudinal direction, wherein each housing compartment comprises a pair of access apertures through which said packets can be introduced into and extracted from the respective housing compartment, said access apertures being disposed on opposite sides with respect to each other so as to define a through housing compartment, having both ends open, to allow the passage of said packets, the packets being received in said housing compartments so that the lower wall and the top wall remain exposed and accessible directly from the outside of the access apertures; and b) a pair of opposite lateral walls, each able to be contacted by a respective lateral wall of greater or lesser extension of the packet, each of said lateral walls comprising a plurality of windows, coupled in such a way as to be facing opposite each other on the respective lateral walls so as to define through cavities which extend in a perpendicular to said longitudinal direction, said windows being intended to receive guide means configured to interact with the spacer support during the introduction of the packets inside the respective housing compartments; and c) a pair of connection walls that extend between said lateral walls to connect the lateral walls, and on which a plurality of said access apertures and a plurality of positioning elements are made, said plurality of positioning elements being able to contact a respective lateral wall of greater or lesser extension of the packet disposed inside a respective housing compartment, where on each connection wall the access apertures and the positioning elements are disposed alternately one after the other, in succession in said longitudinal direction, so that said opposite lateral walls and said positioning elements delimit said housing compartments in order to stably hold said packets inside them in a static manner, in said longitudinal direction, said positioning elements being provided one after the other at a fixed distance which is at least equal to or greater than a characteristic size of the packet, measured in said longitudinal direction, defined as the extension of the lateral walls of greater or lesser extension, so as to dispose and hold the packets in the respective housing compartments at a constant pitch between them, coordinated with said distance.

11. The spacer kit as in claim 10, wherein said spacer kit comprises five pairs of packets, distanced from each other in said longitudinal direction by an interspace in correspondence with which one of said positioning elements is made and a pair of said windows, each on a respective lateral wall.

12. The spacer kit as in claim 10, wherein said lower wall and said top wall protrude beyond said opposite lateral walls.

13. A method for assembling a spacer kit as in claim 10, wherein said method comprises the steps of:

making available the spacer support having a tubular shape and having the plurality of housing compartments to receive each one or more packets for smoking articles, introducing an ordered group of packets of smoking articles into said housing compartments by pushing means, during the introducing step, engaging with guide means a plurality of windows made on one pair of lateral walls, of the spacer support; said guide means being configured to pass through said windows so as to pass through the spacer support from one side to the other in order to keep its shape stable during the introduction of the packets by laterally delimiting said housing compartments.

14. The method as in claim 13, comprising the step of providing the spacer support in a flattened or flat configuration, and opening the spacer support from a flattened or flat configuration into said tubular shape.

15. The method as in claim 13, wherein said further comprising feeding an extended blank, which is subsequently folded along creasing or folding lines which extend parallel to the longitudinal direction, where on at least one flap of the blank, an adhesive substance is deposited so as to allow said flap to be firmly associated with another flap of the blank and form said tubular shape of the spacer support.

* * * * *